US009972454B1

(12) United States Patent
Cohen et al.

(10) Patent No.: US 9,972,454 B1
(45) Date of Patent: May 15, 2018

(54) GROUNDING CONNECTIONS IN A TACTILE SWITCH ASSEMBLY

(71) Applicant: Apple Inc., Cupertino, CA (US)

(72) Inventors: Sawyer I. Cohen, Cupertino, CA (US); Tyler B. Cater, Cupertino, CA (US); Ramachandran Chundru, Cupertino, CA (US); Vivek Katiyar, Cupertino, CA (US); Marwan Rammah, Cucpertino, CA (US); Ashutosh Y. Shukla, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 204 days.

(21) Appl. No.: 14/867,336

(22) Filed: Sep. 28, 2015

Related U.S. Application Data

(60) Provisional application No. 62/058,053, filed on Sep. 30, 2014, provisional application No. 62/215,391, filed on Sep. 8, 2015.

(51) Int. Cl.

| | |
|---|---|
| ***H01H 1/10*** | (2006.01) |
| ***H01H 3/12*** | (2006.01) |
| ***H01H 11/00*** | (2006.01) |
| *H01H 3/00* | (2006.01) |

(52) U.S. Cl.
CPC ..... *H01H 3/12* (2013.01); *H01H 11/00* (2013.01); *H01H 2003/008* (2013.01); *H01H 2011/0087* (2013.01)

(58) Field of Classification Search
CPC ..... H01H 3/10; H01H 3/7006; H01H 3/12; H01H 11/00; H01H 2003/08; H01H 2003/12; H01H 2011/0087; H01H 2205/016; H01H 2239/008; H01H 9/00; H01H 9/02; H01H 9/04; H01H 9/48; H01H 2009/02; H01H 2013/00; H01H 2013/50; H01H 2215/00; H01H 2215/004; H01H 2227/022; H01H 13/00; H01H 13/02; H01H 13/04; H01H 13/10; H01H 13/12; H01H 13/50; H01H 13/52
USPC ..... 200/512, 534; 343/702, 709, 700 MS, 343/833, 836; 439/92, 881; 174/75, 78, 174/756
See application file for complete search history.

(56) References Cited

U.S. PATENT DOCUMENTS

| | | | | |
|---|---|---|---|---|
| 7,889,139 | B2 * | 2/2011 | Hobson | H01Q 1/243 343/702 |
| 2010/0296211 | A1 * | 11/2010 | Bruandet | H01H 13/704 361/56 |
| 2012/0050958 | A1 * | 3/2012 | Sanford et al. | G06F 1/1626 361/679.01 |

* cited by examiner

*Primary Examiner* — Anthony R. Jimenez
(74) *Attorney, Agent, or Firm* — David K. Cole

(57) ABSTRACT

An electronic device includes a tactile switch assembly. The tactile switch assembly includes a tactile switch structure. A grounding structure can be included in an electrostatic discharge path in the tactile switch structure. The grounding structure can result in a shorter electrostatic discharge path that minimizes damage caused by an electrostatic discharge event. Additionally, different grounding connectors are disclosed that can attach to a grounded component in the electronic device and to a tactile switch bracket associated with the tactile switch assembly. The grounding connector provides a grounding connection to the tactile switch bracket.

17 Claims, 16 Drawing Sheets

GROUNDING CONNECTIONS IN A TACTILE SWITCH ASSEMBLY

CROSS-REFERENCE TO RELATED APPLICATION(S)

This application is a nonprovisional patent application of and claims the benefit of U.S. Provisional Patent Application No. 62/058,053, filed on Sep. 30, 2014, and titled "Electrostatic Discharge In A Biometric Sensor" and U.S. Provisional Patent Application No. 62/215,391, filed Sep. 8, 2015 and titled "Grounding Connections in a Tactile Switch Assembly," the disclosures of which are hereby incorporated herein by reference in their entireties.

FIELD

The described embodiments relate generally to electronic devices. More particularly, the present embodiments relate to a grounding connection in or to a tactile switch assembly.

BACKGROUND

Electrostatic discharge (ESD) can become problematic in electronic devices. ESD is the sudden flow of electricity between two electrically charged objects. ESD can be caused by static electricity which is often generated through tribocharging. Tribocharging occurs when one material becomes electrically charged after it comes into frictional contact with a different material. So, for example, tribocharging may occur when a user of an electronic device walks on a surface such as a carpet, moves into or out of a fabric seat such as in an automobile or other type of seat, or when the user removes some types of plastic packaging from the electronic device. The sudden discharge of electricity caused by ESD can be damaging to many electronic components, especially microchips. A grounding connection or path is one technique for limiting the damage caused by ESD. Additionally, a grounded component can be used by a second component in an electronic device to improve operations of the second component or to improve signal transmissions that are related to the second component.

SUMMARY

In one aspect, an electronic device includes a tactile switch assembly that is configured to receive user inputs. The tactile switch assembly can include a tactile switch structure having a switch mechanism, such as a dome switch. The tactile switch structure includes a first flexible circuit attached to a first surface of a stiffener, and a component chamber formed in the stiffener. A portion of the first flexible circuit is exposed in the component chamber. A grounding structure may be attached to the exposed portion of the first flexible circuit to electrically connect the stiffener to the first flexible circuit. The grounding structure provides an electrostatic discharge path between the stiffener and the flexible circuit.

In one embodiment, the grounding structure is a conductive post that is soldered to the flexible circuit. The solder contacts the edges of the stiffener in the component chamber. In some embodiments, the conductive post is soldered to the flexible circuit with a higher temperature solder. A lower temperature solder can fill the component chamber and contact the edges of the stiffener.

In another embodiment, the grounding structure can be a wire bond. The wire bond may be attached between two portions of the same flexible circuit or of two different flexible circuits.

In another aspect, the tactile switch structure may include a flexible circuit and a stiffener. A first surface of the flexible circuit can attach to a trim that is adjacent the tactile switch structure, and a second surface of the flexible circuit may attach to the stiffener. An electrostatic discharge path is formed between the trim and the stiffener through the flexible circuit. In some embodiments, at least one grounding structure can be attached between the second surface of the flexible circuit and the stiffener. An electrostatic discharge path is formed between the trim and the stiffener through the flexible circuit and the at least one grounding structure. As one example, the at least one grounding structure may be a wire crush rib.

In some embodiments, a method for forming a grounding structure in a tactile switch structure in an electronic device can include attaching the grounding structure to a first surface of a flexible circuit and deforming the grounding structure by positioning a stiffener below the flexible circuit to create an electrical contact between the stiffener and the grounding structure. The grounding structure may then be welded to the flexible circuit through the stiffener. Welding through the stiffener can cause the grounding structure to attach to the stiffener such that the grounding structure is electrically connected to the stiffener and to the flexible circuit.

In yet another aspect, a tactile switch assembly can include a tactile switch bracket that is associated with the tactile switch assembly, a grounded component adjacent the tactile switch bracket, and a grounding connector attached to the grounded component and to the tactile switch bracket to provide a grounding connection to the tactile switch bracket. In one embodiment, a grounding connector can include a fastener that secures an extension of the grounded component and the tactile switch bracket. One example of a fastener is a screw. A grounding connection is provided to the tactile switch bracket through the extension and the fastener.

In another embodiment, the grounding connector includes a conductive tie bar that is secured to an extension of the grounded component and to the tactile switch bracket with fasteners. Alternatively, a grounding connector can include a conductive jumper that is secured to an extension of the grounded component and to the tactile switch bracket with fasteners. In other embodiments, the grounding connector may be a leaf spring, a pogo spring, or a flexible circuit that is attached to an extension of the grounded component and to the tactile switch bracket.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to a tactile switch assembly in an electronic device. The tactile switch assembly is configured to receive user inputs. For example, the tactile switch assembly may include a dome switch that is activated when a downward force is applied to the tactile switch assembly. Additionally or alternatively, the tactile switch assembly can include a biometric sensor, such as a fingerprint sensor. In some embodiments, the biometric sensor can be positioned below a button and configured to capture biometric data (e.g., a fingerprint) when a user presses the button.

In a particular embodiment, an electrostatic discharge (ESD) path is provided in the tactile switch assembly that can reduce the impact of an ESD event on the electrical components in a tactile switch structure in the tactile switch assembly. The ESD path includes a grounding structure, such as a conductive post, that electrically connects a flexible circuit to a stiffener in the tactile switch structure. Alternatively, a grounding structure can electrically connect to two portions of a flexible circuit or to two different flexible circuits.

The tactile switch assembly can be associated with a tactile switch bracket in an electronic device. The tactile switch bracket may support the tactile switch assembly or the tactile switch structure. In some embodiments, the tactile switch bracket can be electrically connected to a grounded component in the electronic device. A grounding connector can be attached between the grounded component and the tactile switch bracket to provide a grounding connection to the tactile switch bracket.

These and other embodiments are discussed below with reference to FIGS. 1-29. However, those skilled in the art will readily appreciate that the detailed description given herein with respect to these Figures is for explanatory purposes only and should not be construed as limiting.

Figure 1:
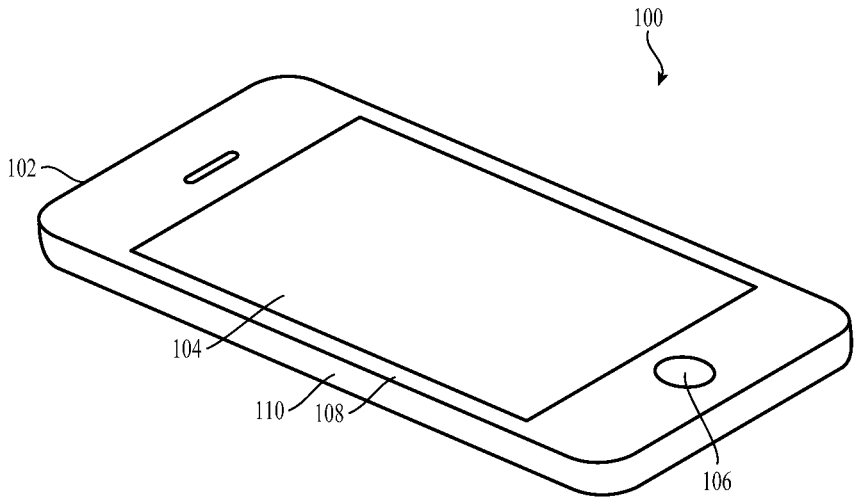
FIG. 1 shows an example electronic device that can include a tactile switch assembly.

FIG. 1 illustrates one example of an electronic device that can include a tactile switch assembly. In the illustrated embodiment, the electronic device 100 is implemented as a smart telephone. In other embodiments, the electronic device can be a different type of electronic device. For example, a tactile switch assembly may be included in a laptop computer, a tablet computing device, a gaming device, a remote control device, and a wearable computing device such as a smart watch.

The electronic device 100 includes a housing 102 at least partially surrounding a display 104 and one or more input/output (I/O) devices 106. The housing 102 can form an outer surface or partial outer surface for the internal components of the electronic device 100, and may at least partially surround the display 104. The housing 102 can be formed of one or more components connected together, such as a front piece 108 and a back piece 110. Alternatively, the housing 102 can be formed of a single piece.

The display 104 can provide a visual output to the user. In some embodiments, the display 104 may incorporate an input device that is configured to receive touch input, force input, temperature input, and the like. The display 104 can be implemented with any suitable technology, including, but not limited to, a multi-touch sensing touchscreen that uses liquid crystal display (LCD) technology, light emitting diode (LED) technology, organic light-emitting display (OLED) technology, organic electroluminescence (OEL) technology, or another type of display technology. The display 104 may be substantially any size and may be positioned substantially anywhere in the electronic device 100.

In the illustrated embodiment, the I/O device 106 is a button. The button 106 can take the form of a home button, which may be a mechanical button, a soft button (e.g., a button that does not physically move but still accepts inputs), an icon or image on a display, and so on. Further, in some embodiments, the button 106 can be integrated as part of a cover glass of the electronic device. In one embodiment, a tactile switch assembly can be disposed below the button 106. The tactile switch assembly can provide a tactile switch for the button 106, and can include other components and features. For example, the tactile switch assembly can include a sensor, such as a fingerprint sensor, a force sensor, a thermal sensor, a light sensor, or a proximity sensor.

Figure 2:
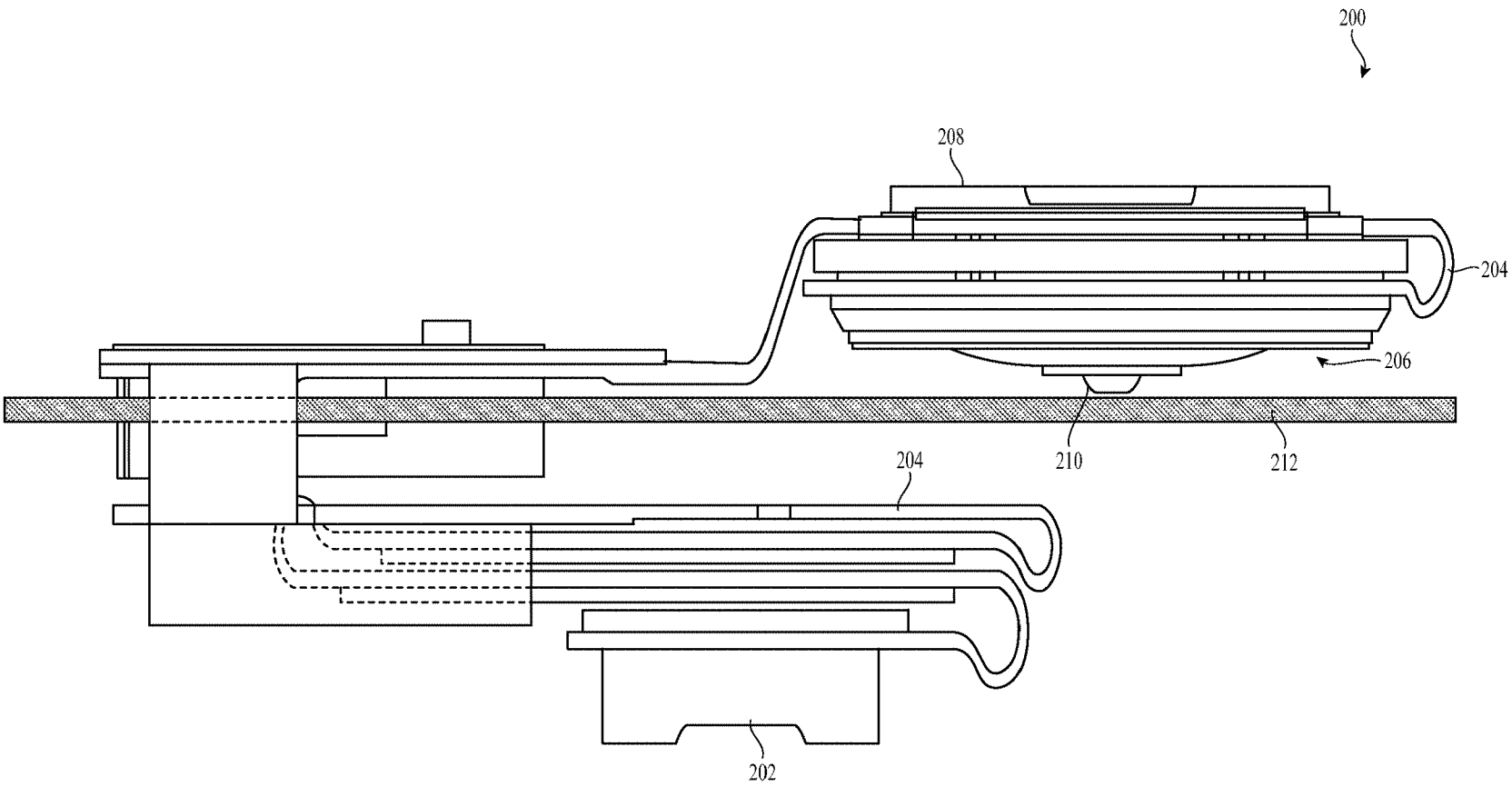
FIG. 2 shows a side view of one example of a tactile switch assembly.

FIG. 2 shows a side view of one example of a tactile switch assembly. The tactile switch assembly 200 includes a connector 202 electrically connected to one end of a flexible circuit 204 and a tactile switch structure 206 electrically connected to the other end of the flexible circuit 204. In some embodiments, the tactile switch structure 206 can include a sensor 208 that positioned at a top surface of the tactile switch structure and electrically connected to the flexible circuit 204. The sensor 208 can be any suitable type of sensor, including, but not limited to, a fingerprint sensor, a force sensor, a light sensor, and a proximity sensor.

Additionally, the tactile switch structure 206 can include any suitable tactile switch. For example, the tactile switch can be a dome switch assembly 210 that is positioned at a bottom surface of the tactile switch structure 206 and electrically connected to the flexible circuit 204. The dome switch assembly 210 can be supported by a support plate 212. When a force is applied to the tactile switch structure 206 (e.g., by pressing on button 106), the dome switch assembly 210 is pressed against the support plate 212, which can cause the dome switch assembly 210 to compress or deform and activate the switch. Other embodiments can use a different type of switch, such as, for example, a force sensing switch.

Figure 3:
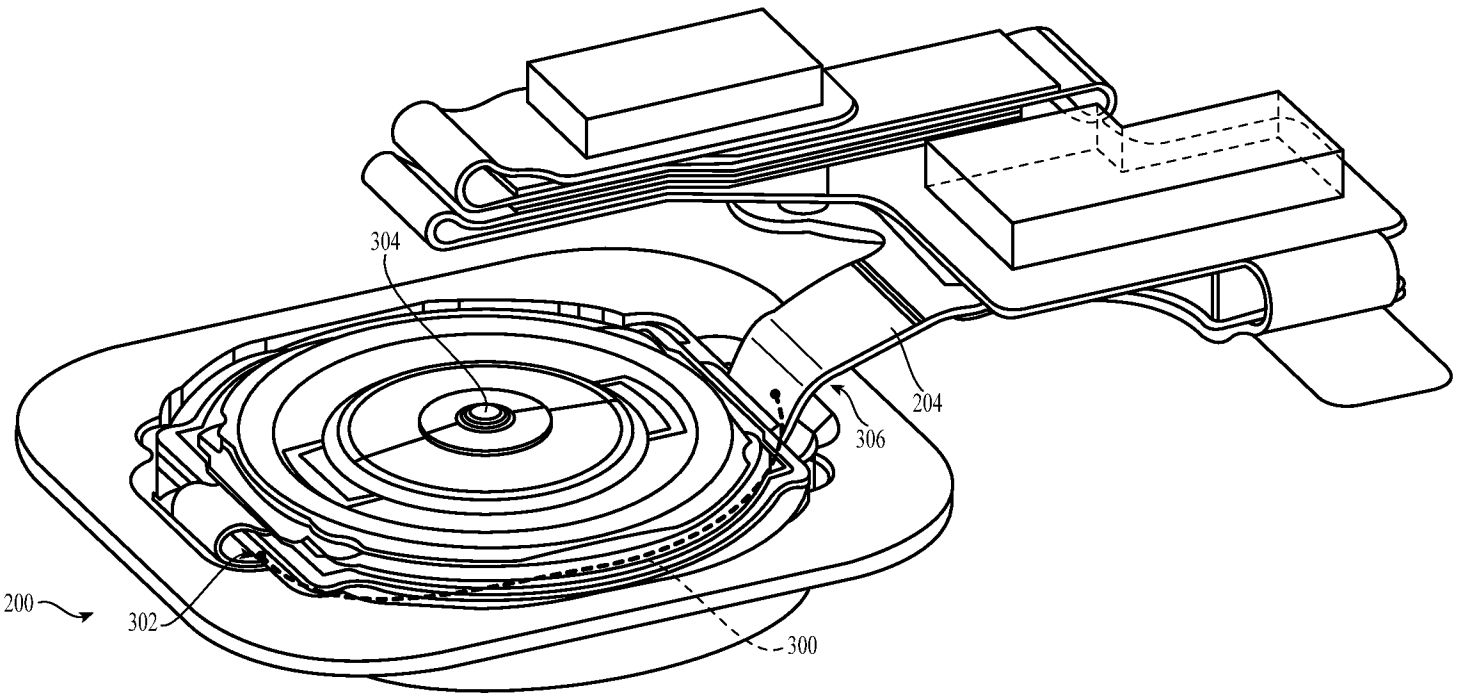
FIG. 3 shows a bottom view of a first tactile switch assembly illustrating a longer electrostatic discharge path.

A user charged with static electricity can cause an ESD event when the user touches or presses the button 106 shown in FIG. 1. The current produced by the ESD event may then dissipate through the tactile switch assembly 200. FIG. 3 shows a bottom view of the tactile switch assembly illustrating a longer ESD path. In some embodiments, an ESD path 300 can originate in area 302 of the tactile switch assembly 200 and travel along the perimeter of the dome switch 304 to the region 306 of the flexible circuit 204. The ESD path 300 is a relatively long path shown by a dotted line. The ESD path 300 allows the current produced by an ESD event to potentially impact various components included in the tactile switch assembly 200 and/or the tactile switch structure 206.

Figure 4:
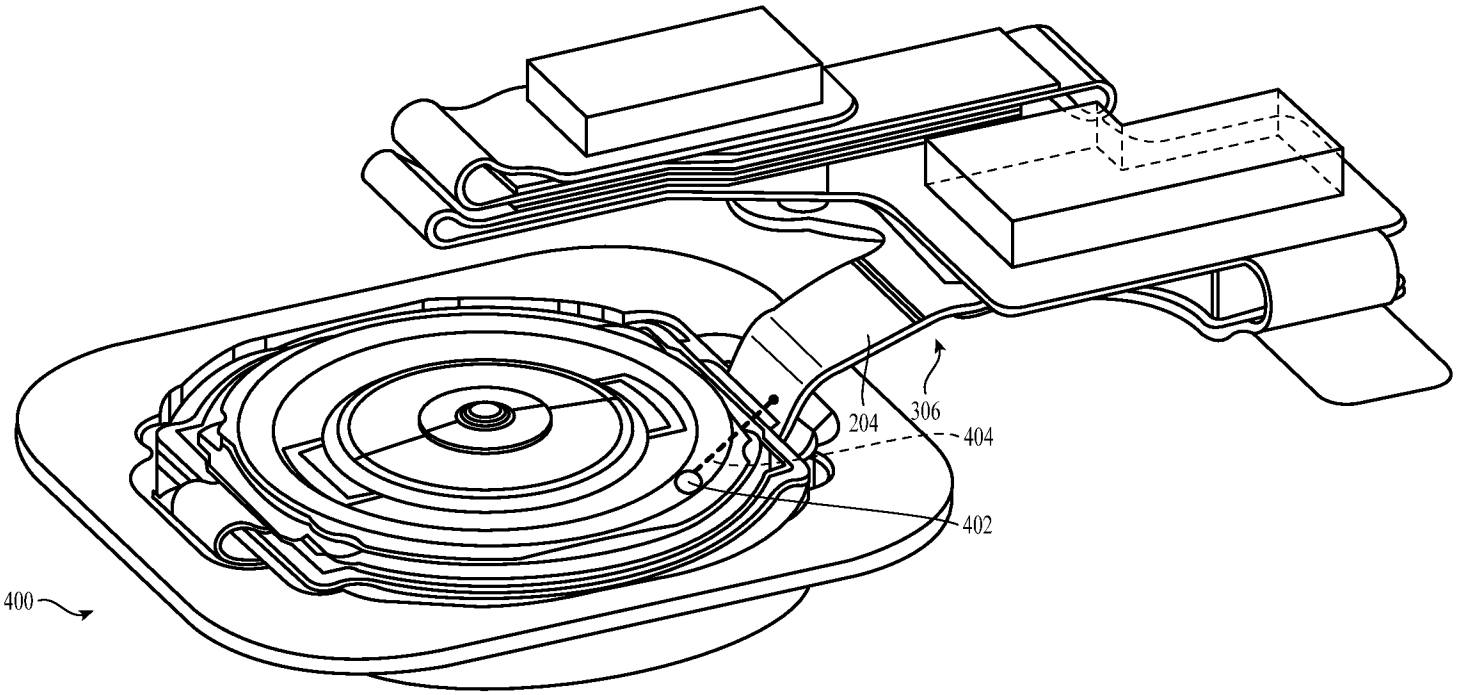
FIG. 4 shows a bottom view of another tactile switch assembly illustrating a shorter electrostatic discharge path.

FIG. 4 shows a bottom view of another tactile switch assembly illustrating a shorter ESD path. The tactile switch assembly 400 includes a grounding structure 402 that ameliorates ESD events that would otherwise damage the tactile switch assembly 400. As described below, the grounding structure 402 produces a shorter ESD path 404 to the region 306 of the flexible circuit 204. The grounding structure 402 is located as close as possible to the region 306 so as to minimize the damage caused by the transmission of an electrical charge during an ESD event. In contrast to the ESD path 300 shown in FIG. 3, the ESD path 404 in FIG. 4 is a shorter ESD path that can reduce the number of electronic components in the tactile switch assembly 400 that are impacted by an ESD event.

Figure 5:
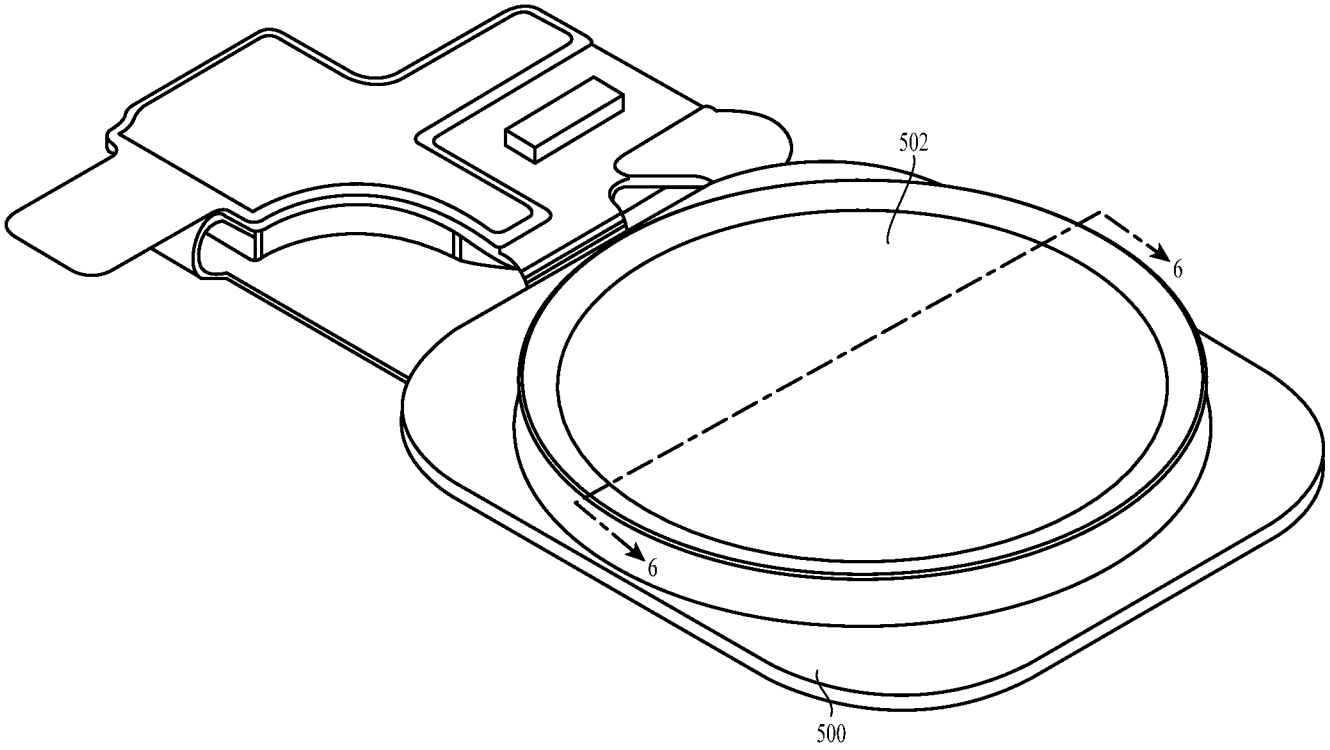
FIG. 5 shows a top view of the tactile switch assembly shown in FIG. 4.

FIG. 5 shows a top view of the tactile switch assembly shown in FIG. 4. The tactile switch assembly 400 includes a trim 500 with an input surface 502 positioned in the trim 500 and over the tactile switch structure. The input surface 502 can be made of any suitable material, including glass, ceramic, sapphire, and plastic. The input surface 502 may be a cover glass, a button, a cap, a switch surface, and so on. The input surface 502 may be touch-sensitive and/or force-sensitive, or otherwise may be associated with a touch sensor and/or force sensor. Additionally, the trim 500 can be made of any suitable material, including metal and plastic, ceramic, and the like. The trim may be electrically conductive and act as a ground for a person touching the input surface in certain embodiments, although this is not necessary or the case in all embodiments.

Figure 6:
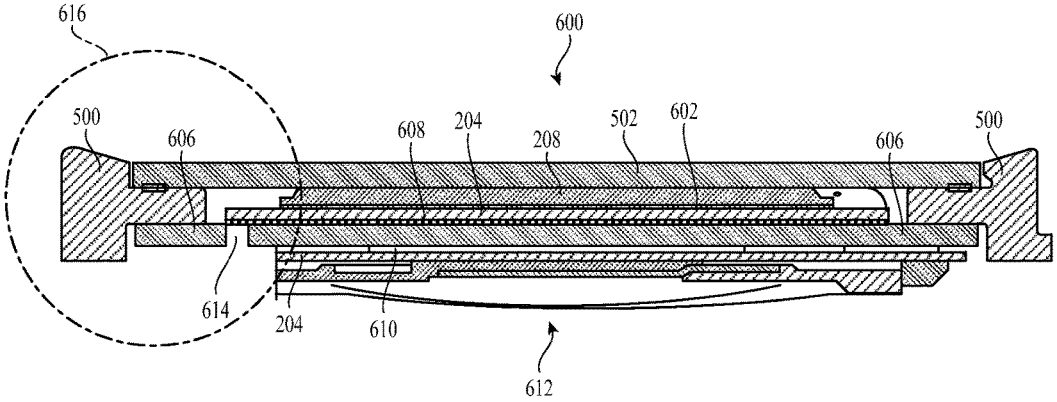
FIG. 6 shows a cross-sectional view of the tactile switch assembly taken along line 6-6 in FIG. 5.

FIG. 6 shows a cross-sectional view of the tactile switch assembly taken along line 6-6 in FIG. 5. The tactile switch structure 600 includes the input surface 502 attached to the trim 500, the sensor 208 disposed under the input surface, and the flexible circuit 204 positioned below the sensor 208. The sensor 208 can be attached to the flexible circuit 204 with an adhesive layer 602, such as a heat cured epoxy. The flexible circuit 204 can wrap around a stiffener 606 (see FIG. 2). A switch 612 may be located beneath the stiffener 606 and input surface 502, such that the switch collapses and generates an electrical input when the input surface is touched or pressed.

The stiffener 606 can be attached to the flexible circuit 204 overlying the stiffener 606 with an adhesive layer 608 and to the flexible circuit 204 underlying the stiffener 606 with another adhesive layer 610. The adhesive layers 608 and 610 can be any suitable type of adhesive, such as, for example, a pressure sensitive adhesive (PSA). The stiffener 606 can be attached to the trim 500 using any suitable technique. For example, in one embodiment the stiffener 606 is welded to the trim 500 at several attachment points (not shown). The dome switch 612 is connected to the portion of the flexible circuit 204 that is positioned under the stiffener 606. A component chamber 614 may be created in an opening in the stiffener 606. A portion of the flexible circuit is exposed in the component chamber 614. As is described in more detail below, in one embodiment a grounding structure can be positioned or included in the component chamber 614 and electrically connected to the flexible circuit 204.

Figure 7:
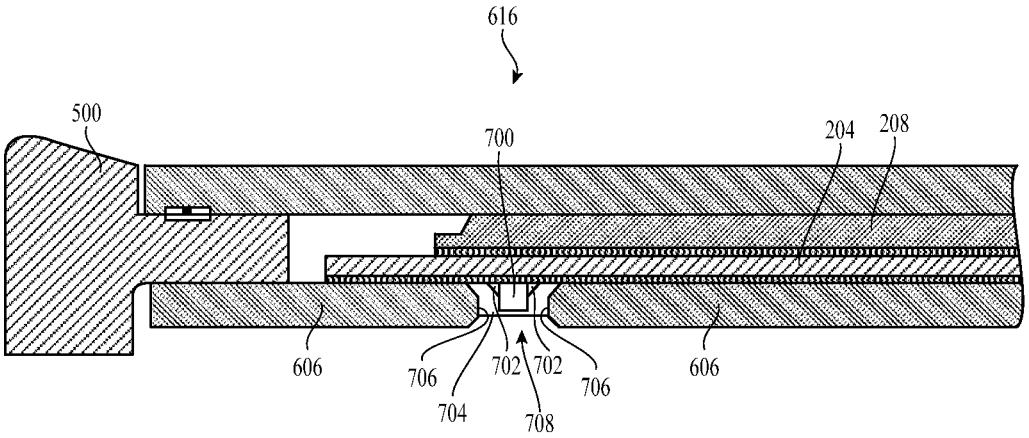
FIG. 7 shows an enlarged view of the area 616 shown in FIG. 6.

FIG. 7 shows an enlarged view of the area 616 shown in FIG. 6. A conductive post 700 is positioned within the component chamber 614 and is mounted to the exposed portion of the flexible circuit 204. In the illustrated embodiment, the conductive post 700 is soldered to the flexible circuit 204 with solder 702. Other embodiments can attach the conductive post 700 using a different attachment method, such as, for example, a conductive adhesive. In one embodiment, the solder 702 is a higher temperature solder. After the conductive post 700 is attached to the flexible circuit 204 with the higher temperature solder 702, a lower temperature solder 704 may be introduced into the area of component chamber 614 to at least partially fill the component chamber 614 and contact the conductive post 700. The lower temperature solder 704 also contacts the edges 706 of the stiffener 606 in the component chamber 614. In one embodiment, the lower temperature solder 704 is disposed in the component chamber 614 through laser soldering.

The lower temperature solder 704 can be selected so as to not affect the higher temperature solder 702. That is, the lower temperature solder 704 has a lower melting point than the higher temperature solder 702, so the higher temperature solder 702 is not impacted by the introduction of the lower temperature solder 704 into the component chamber 614. Thus, the conductive post 700 can remain securely attached to the flexible circuit 204 when the lower temperature solder 704 is introduced into the component chamber 614.

In some embodiments, the edges 706 of the stiffener 606 are chamfered to provide mechanical support to the lower temperature solder 704 and help secure the higher temperature solder 702 in the component chamber 614. In some embodiments, the stiffener 606 and the conductive post 700 include a material with a low thermal conductivity to retain heat from the soldering operation performed in and around the stiffener 606 and the conductive post 700. For example, the stiffener 606 and the conductive post 700 may include or be formed with a material such as a 300 series stainless steel.

The chamfered edges 706 and the conductive post 700 may be plated with a suitable material to aid in flowing or wetting the lower temperature solder 704 around the conductive post 700 and the chamfered edges 706. Gold is one example of a suitable material. Because a material such as gold may assist in defining where the lower temperature solder 704 may or may not flow, in one embodiment the surfaces of the chamfered edges 706 may be plated with gold but not the top and bottom surfaces of the stiffener 606. The stiffener surfaces other than the chamfered edges 706 may be plated with or made of nickel or another suitable material that is less conducive to flowing solder, which can help in containing the lower temperature solder 704 between the chamfered edges 706 and within the area of the component chamber 614 that surrounds the conductive post 700. In other embodiments, various surfaces may be selectively plated with nickel or other suitable material to define the flow of the lower temperature solder to those surfaces.

Additionally, the chamfered edges 706 can assist in mechanically holding or restraining the lower temperature solder 704 in the component chamber 614 and prevent a mechanical load transfer to the flexible circuit 204 and the sensor 208 This may prevent the lower temperature solder 704 from being dislodged from the component chamber 614 due to vibrations or other activity associated with the electronic device. Additionally, the combination of the conductive post 700 and the lower temperature solder 704 provide a secure electrical connection that can be mechanically stress free or experience a reduced amount of mechanical stress.

In operation, the conductive post 700 is included in an ESD discharge path that begins at the trim 500 and passes through the stiffener 606 to the lower temperature solder 704, to the conductive post 700, and to the flexible circuit 204. Thus, a grounding structure 708 is formed by the combination of the conductive post 700, the higher temperature solder 702, and the lower temperature solder 704. The ESD discharge path may then continue to a grounding trace within, or to a grounding connection connected to, the flexible circuit 204. This shorter ESD discharge path reduces the possibility that one or more electronic components in the tactile switch assembly are damaged.

Figure 8:
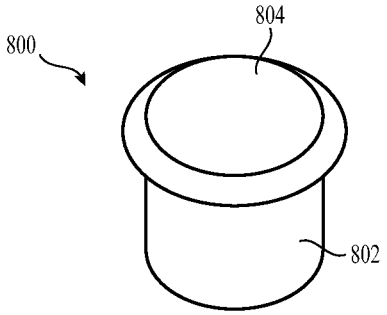
FIG. 8 shows a first example of a grounding structure.

FIG. 8 shows a first example of a post that can be included in a grounding structure. The post 800 is illustrated as a "top hat" post. The conductive post 800 includes a cylindrical post 802 attached to a larger diameter top portion 804. The larger diameter top portion 804 can protect the flexible circuit 204 from damage when the top portion 804 is laser soldered or otherwise affixed to the flexible circuit 204. Additionally or alternatively, since the larger diameter top portion 804 covers more surface area of the flexible circuit 204, the top portion 804 may also result in a more secure attachment of the conductive post 800 to the flexible circuit 204.

Figure 9:
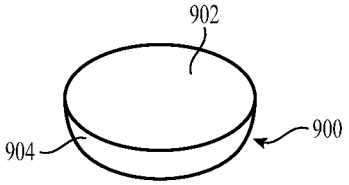
FIG. 9 shows a second example of a grounding structure.

FIG. 9 shows a second example of a conductive post that can be included in a grounding structure. The conductive post 900 is depicted as a conical post. In this embodiment, the top portion 902 has a larger diameter and surface area than the other portions 904 of the conductive post 900. Like the conductive post 800 shown in FIG. 8, the larger diameter top portion 902 can protect the flexible circuit 204 from damage when the conductive post 900 is soldered onto the flexible circuit 204. Additionally, the larger diameter top portion 902 can result in a more secure attachment of the conductive post 900 to the flexible circuit 204 since the larger diameter top portion 902 covers more surface area of the flexible circuit 204. In other embodiments, a conductive post can be shaped differently. For example, a conductive post may have a triangular, trapezoidal, or rectangular shape.

Figure 10:
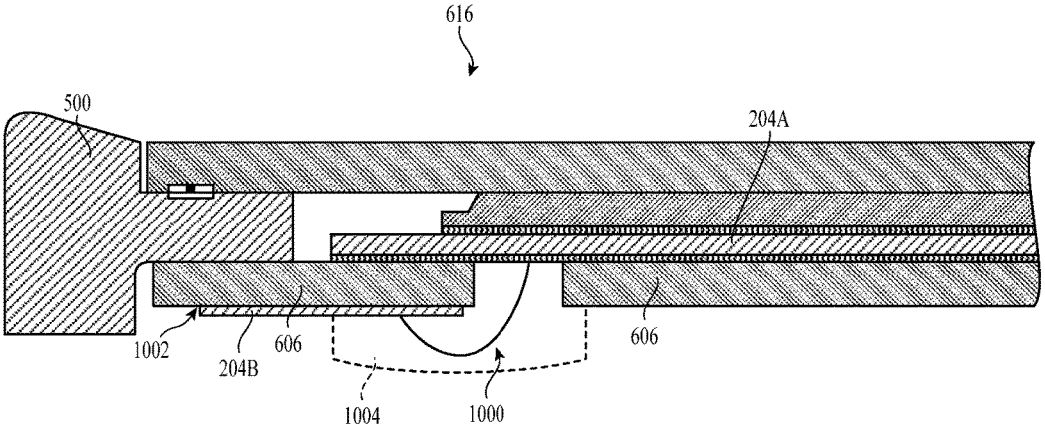
FIG. 10 shows another enlarged view of the area 616 shown in FIG. 6.

FIG. 10 shows another enlarged view of the area 616 shown in FIG. 6. In another embodiment, a grounding structure 1000 is attached to an upper portion 204A and lower portion 204B of the flexible circuit 204. In the illustrated embodiment, the grounding structure 1000 is a wire bond that may be made of any suitable conductive material, such as gold. One end of the wire bond is attached to the lower portion 204B of the flexible circuit 204 and the other end is attached to the upper portion 204A of the flexible circuit 204. In other embodiments, the upper and lower portions can be two distinct flexible circuits.

The upper and lower portions 204A, 204B of the flexible circuit 204 may be attached to the stiffener 606 by a conductive adhesive 1002. The grounding structure 1000 may be encapsulated with a nonconductive material 1004 (shown in dashed lines) so as to prevent the grounding structure 1000 from detaching from the upper and lower portions 204A, 204B of the flexible circuit 204. For example, encapsulating the grounding structure 1000 can prohibit the grounding structure 1000 from detaching from the upper and lower portions 204A, 204B when the flexible circuit 204 and/or the electronic device is subjected to strong mechanical forces (e.g., when the electronic device is dropped). In the embodiment shown in FIG. 10, the ESD discharge path may begin at the trim 500 and pass through the stiffener 606, to the lower portion 204B of the flexible circuit 204, to the grounding structure 1000, and to the upper portion 204A of the flexible circuit 204. The ESD discharge path may then continue to a grounding trace within, or to a grounding connection connected to, the flexible circuit 204.

Figure 11A:
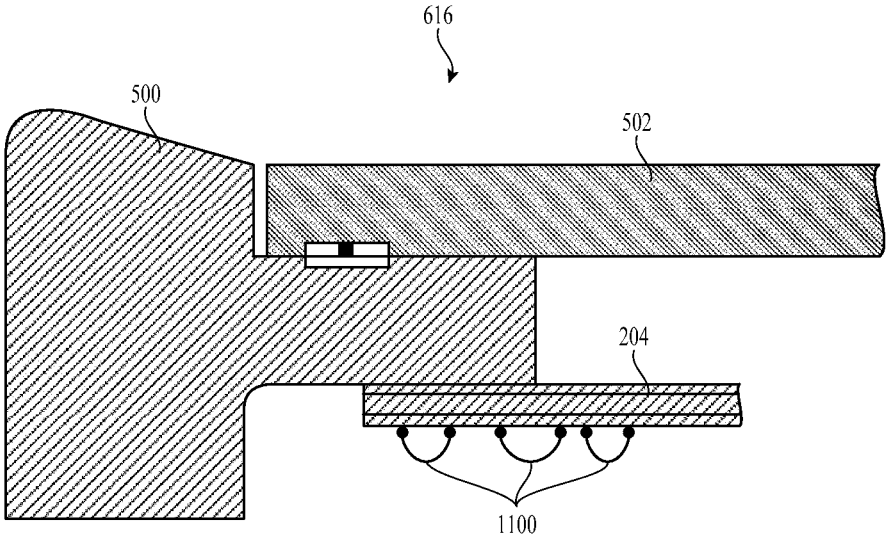
FIGS. 11A-11C show other enlarged views of the area 616 shown in FIG. 6.
Figure 11B:
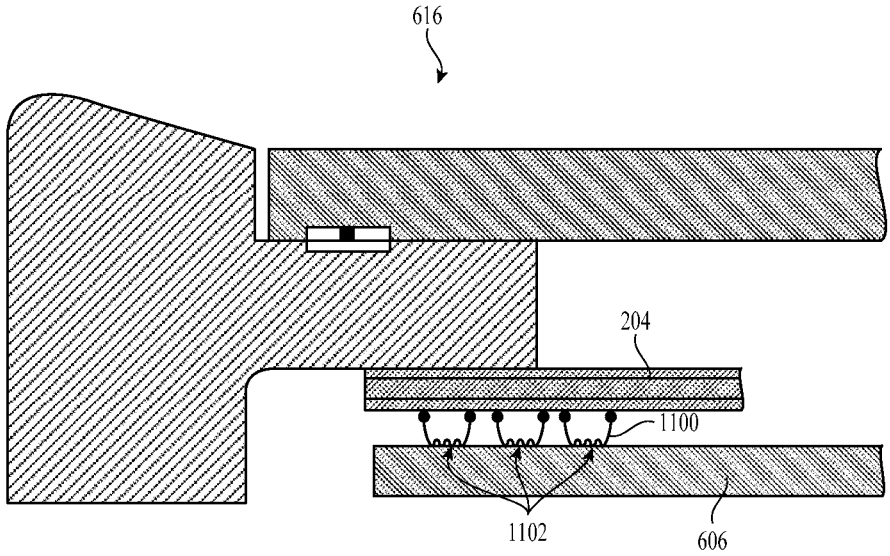
Figure 11C:
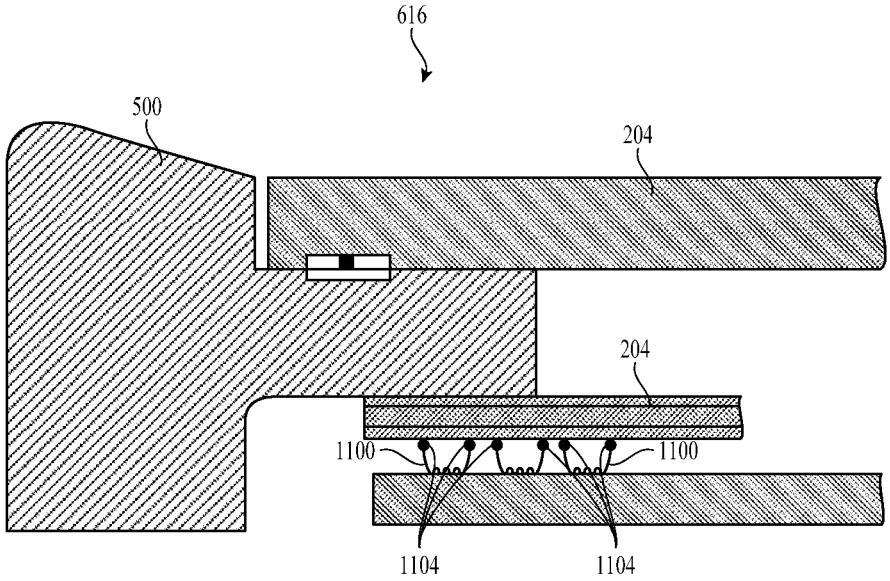

FIGS. 11A-11C show other enlarged views of the area 616 shown in FIG. 6 that depict another grounding structure. In FIG. 11A, only the trim 500, the input surface 502, and the flexible circuit 204 are shown. A first surface (e.g., top surface) of the flexible circuit 204 is attached to the trim 500 and one or more grounding structures 1100 are attached to a second surface (e.g., bottom surface) of the flexible circuit 204. In one embodiment, the first surface of the flexible circuit 204 can be attached to the trim 500 with a conductive adhesive (not shown). In the illustrated embodiment, each grounding structure 1100 is configured as a wire crush rib. The one or more wire crush ribs may be formed with gold, copper, or any other suitable material.

In FIG. 11B, the structure of FIG. 11A is shown with the stiffener 606 positioned below a second surface of the flexible circuit 204 and contacting the grounding structure(s) 1100 (e.g., the one or more wire crush ribs) to deform the wire crush rib(s) at areas 1102. The crushing of the one or more wire crush ribs provides some mechanical compliance for the stiffener 606. Each deformed area 1102 can create an electrical contact between the stiffener 606 and a respective wire crush rib.

In FIG. 11C, the one or more grounding structures 1100 (e.g., the wire crush rib or ribs) can be welded to the flexible circuit 204 at contact points 1104. In the illustrated embodiment, the grounding structure(s) 1100 are welded to the second surface of the flexible circuit 204 through the stiffener 606. By heating the stiffener 606, the wire crush ribs may be made to flow and attach to the stiffener 606. Thus, the one or more wire crush ribs are affixed and electrically connected to the stiffener 606 and to the flexible circuit 204. An ESD discharge path may begin at the trim 500, pass to the flexible circuit 204, to the one or more grounding structures 1100, to the stiffener 606, and to and to another portion of flexible circuit 204 (not shown) that is attached to the stiffener 606.

In other embodiments, a different type of grounding structure can be attached to the flexible circuit and the stiffener. As one example, a conductive contact can be formed on a surface of the stiffener opposite the flexible circuit. The conductive contact can electrically connect to the flexible circuit when the stiffener is positioned adjacent to the flexible circuit.

Figure 12:
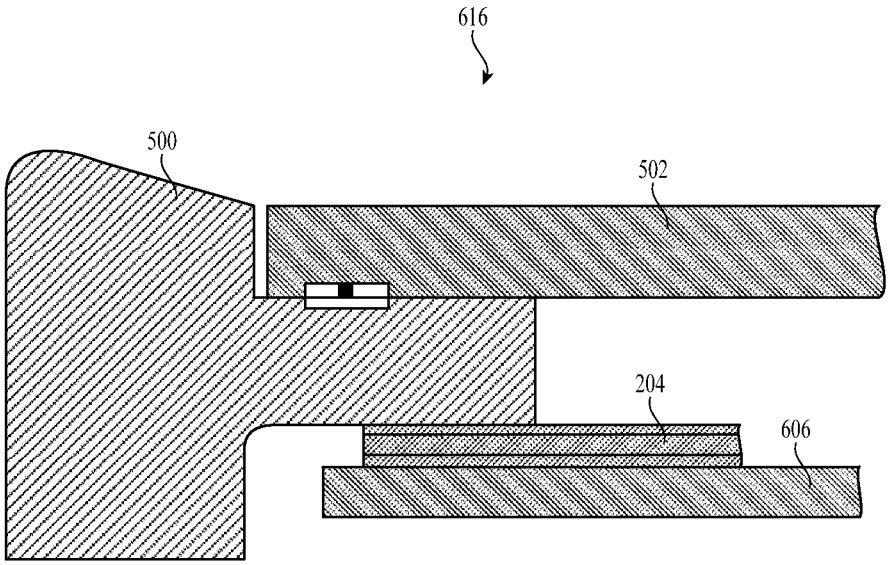
FIG. 12 shows another enlarged view of the area 616 shown in FIG. 6.

FIG. 12 shows another enlarged view of the area 616 shown in FIG. 6. In FIG. 12, only the trim 500, the input surface 502, the flexible circuit 204, and the stiffener 606 are depicted. A first surface (e.g., top surface) of the flexible circuit 204 is attached to the trim 500 and a second surface (e.g., bottom surface) of the flexible circuit is attached to the stiffener 606. In some embodiments, the flexible circuit 204 can be welded to the trim 500 through the stiffener 606. By welding through the stiffener 606 (e.g., with a laser), the stiffener 606 reflows to form a weld with the flexible circuit 204 and the trim 500. The ESD discharge path begins at the trim 500, passes to the flexible circuit 204, to the stiffener 606, and to another portion of the flexible circuit 204 (not shown) attached to the stiffener 606.

In some embodiments, the tactile switch assembly can be used to provide or increase the size of a ground plane for an antenna in the electronic device through a grounding connection to the tactile switch assembly. For example, in one embodiment a grounding connection can be provided to a tactile switch bracket that is associated with the tactile switch assembly. In such an embodiment, a grounding connection can extend from one grounded conductive structure in the electronic device to the tactile switch bracket. Any suitable grounded conductive structure can be used, such as, for example, a midplate or a support plate that is positioned under a display (e.g., display 104 in FIG. 1). Additionally, in some embodiments it may be desirable to establish the grounding connection in such a manner that the electronic device may be disassembled and reassembled without permanently destroying the grounding connection.

Figure 13A:
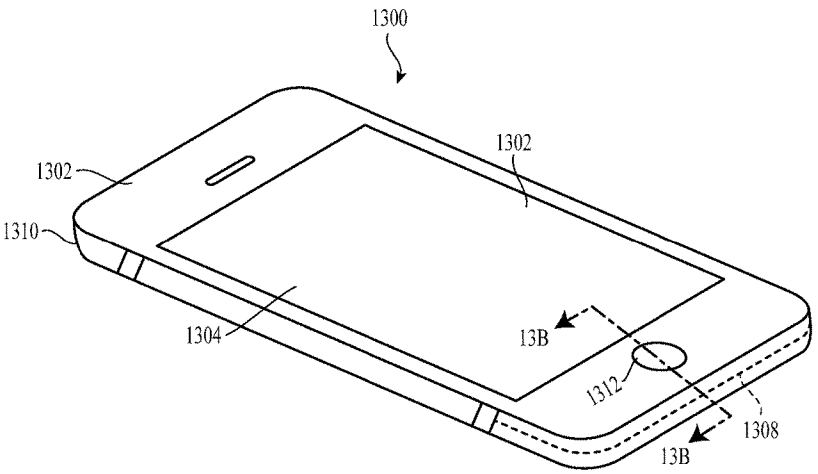
FIG. 13A shows an electronic device that can include a tactile switch assembly and a support plate that provides a grounding connection for a tactile switch bracket associated with the tactile switch assembly.
Figure 13B:
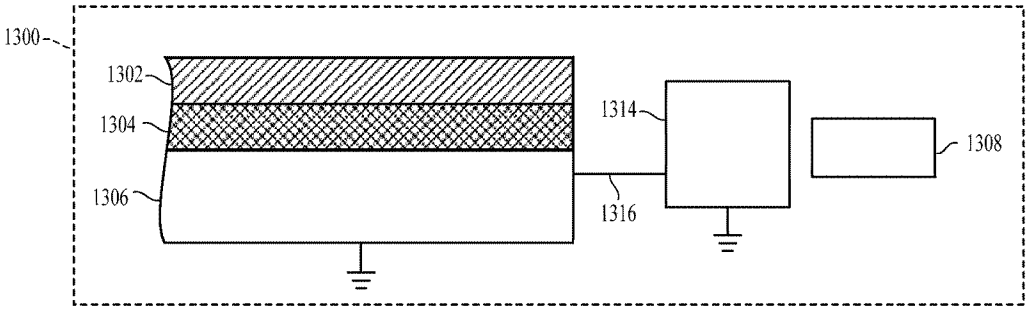
FIG. 13B is a cross-sectional view of the electronic device taken along line 13B-13B shown in FIG. 13A.

FIG. 13A shows an electronic device that can include a tactile switch assembly and a grounded support plate that provides a grounding connection for a tactile switch assembly. FIG. 13B is a cross-sectional view of the electronic device taken along line 13B-13B in FIG. 13A. The electronic device 1300 includes various electronic components that are connected to a system grounding connection. The ground voltage can act as a reference voltage for some components and/or as a common return path for the components. In the illustrated embodiment, the tactile switch assembly can act as a ground plane for an antenna in the electronic device 1300. Various embodiments are disclosed herein for a grounded support plate to provide a grounding connection to a bracket of the tactile switch assembly. The grounding connection allows the bracket to act as a ground plane for the antenna.

Referring to FIGS. 13A and 13B, the electronic device 1300 includes a input surface 1302 disposed over a surface of the electronic device 1300, including a display 1304. A grounded support plate 1306 is positioned under the display 1304. The grounded support plate 1306 can mechanically support the display and other components in the electronic device. In some embodiments, the grounded support plate 1306 acts as a heat sink to dissipate heat. Additionally or alternatively, the grounded support plate 1306 can provide a ground and ground reference for a touch input device, such as a touchscreen and act as a ground plane for an antenna 1308. In the illustrated embodiment, the antenna 1308 is positioned around an interior perimeter of the enclosure 1310 of the electronic device 1300.

As described earlier, a tactile switch assembly can be disposed under the input/output device 1312 (e.g., the button). In some embodiments, the tactile switch assembly can include a tactile switch bracket 1314 that is grounded via a grounding connection 1316 to the grounded support plate 1306. The grounded tactile switch bracket 1314 can act as a ground plane for the antenna 1308.

Figure 14:
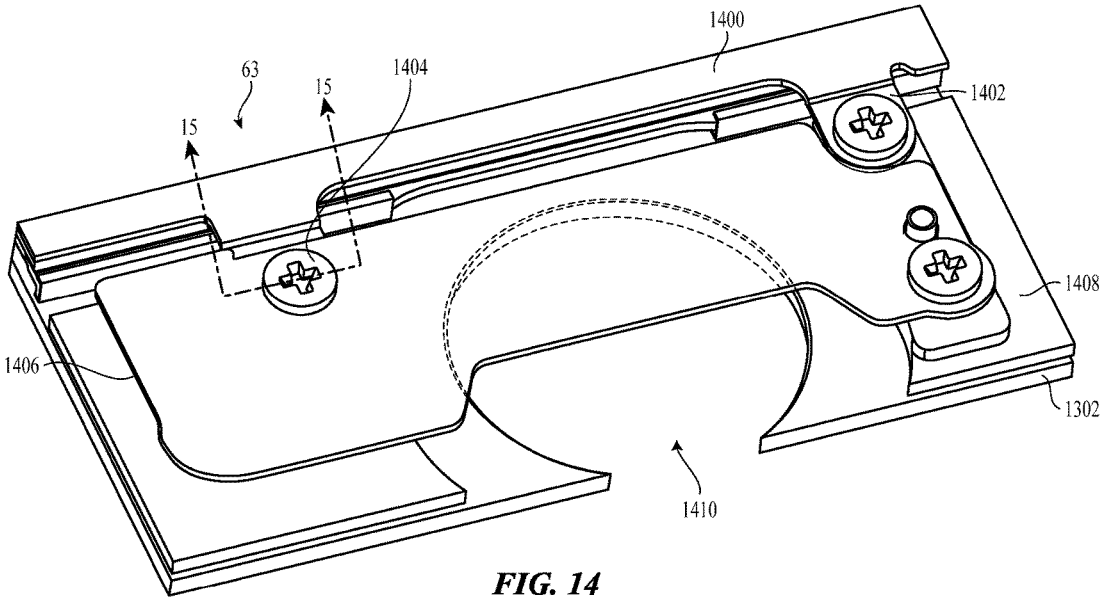
FIG. 14 shows a first embodiment of a tactile switch bracket connected to a grounded support plate.
Figure 15:
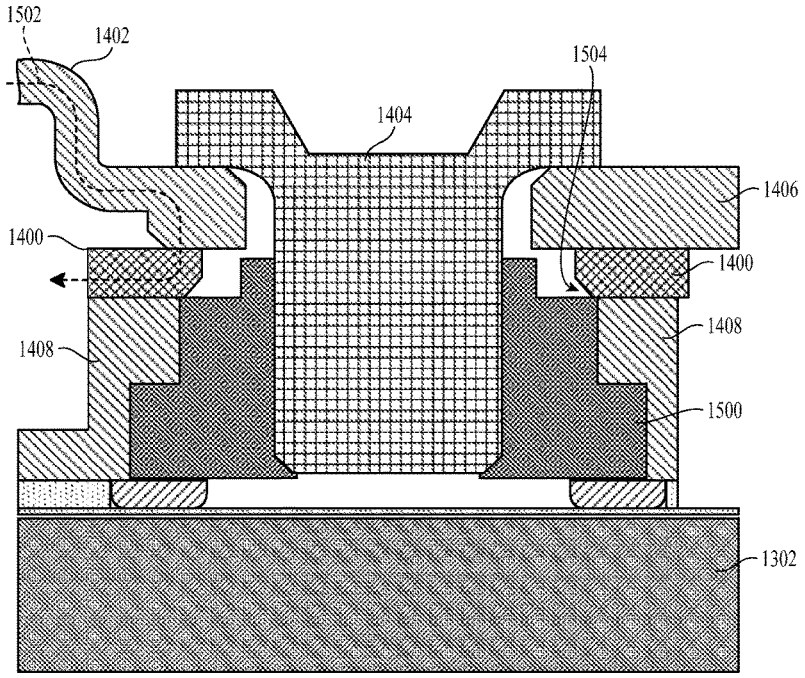
FIG. 15 shows a cross-sectional view taken along line 15-15 shown in FIG. 14.

FIGS. 14 and 15 show a first embodiment of a tactile switch bracket connected to a grounded support plate. A grounded support plate 1400 is attached to, or includes, an extension 1402 that extends out from the grounded support plate 1400 toward the tactile switch bracket 1406. The extension 1402 includes an opening (not shown) for a first fastener 1404. For simplicity, only a portion of the grounded support plate 1400 is shown in FIG. 14. The first fastener 1404 is a screw in the illustrated embodiment. A tactile switch bracket 1406 is disposed under a frame 1408, and includes an opening (not shown) for the first fastener 1404. The frame 1408 is positioned under the input surface 1302 shown in FIG. 13. The exterior surface of the I/O device 1312 (see FIG. 13A) is positioned in the opening 1410 of the frame 1408 and the input surface 1302.

A second fastener 1500 (see FIG. 15) configured to secure to the first fastener 1404 is disposed in, or attached to the frame 1408. In the illustrated embodiment, the second fastener 1500 is a threaded nut that is welded to the frame 1408. When the first and second fasteners 1404, 1500 are secured together, the grounded support plate 1400 and the extension 1402 are secured between the frame 1408 and the tactile switch bracket 1406. A grounding connection 1502 is provided between the extension 1402 and the grounded support plate 1400 and extends to the bracket 1406 via a grounding connector that includes the extension 1402 and the first fastener 1404. Thus, the tactile switch bracket 1406 is connected to ground and can act as a ground plane or shield for the antenna 1308 (see FIG. 13A-13B). Additionally, the grounding connector can be assembled and disassembled without damage because the first and second fasteners 1404, 1500 can be easily coupled and decoupled.

In some embodiments, the second fastener 1500 is subflush of the top surface of the grounded support plate 1400 to ensure a face-to-face grounding connection between the tactile switch bracket 1406 and the grounded support plate 1400. A chamfer corner 1504 on the grounded support plate 1400 can isolate the second fastener 1500 from the tactile switch bracket 1406 and the grounded support plate 1400 to prevent a common ground discharge from interfering with the grounding connection 1502.

Figure 16:
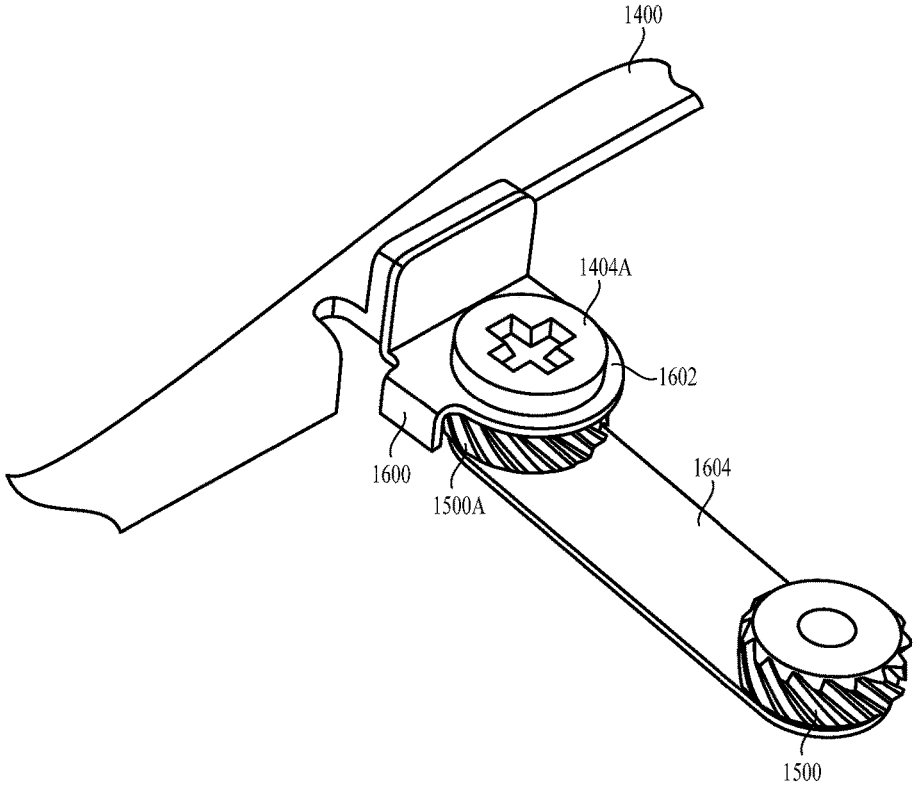
FIGS. 16 and 17 show a second embodiment of a tactile switch bracket connected to a grounded support plate.
Figure 17:
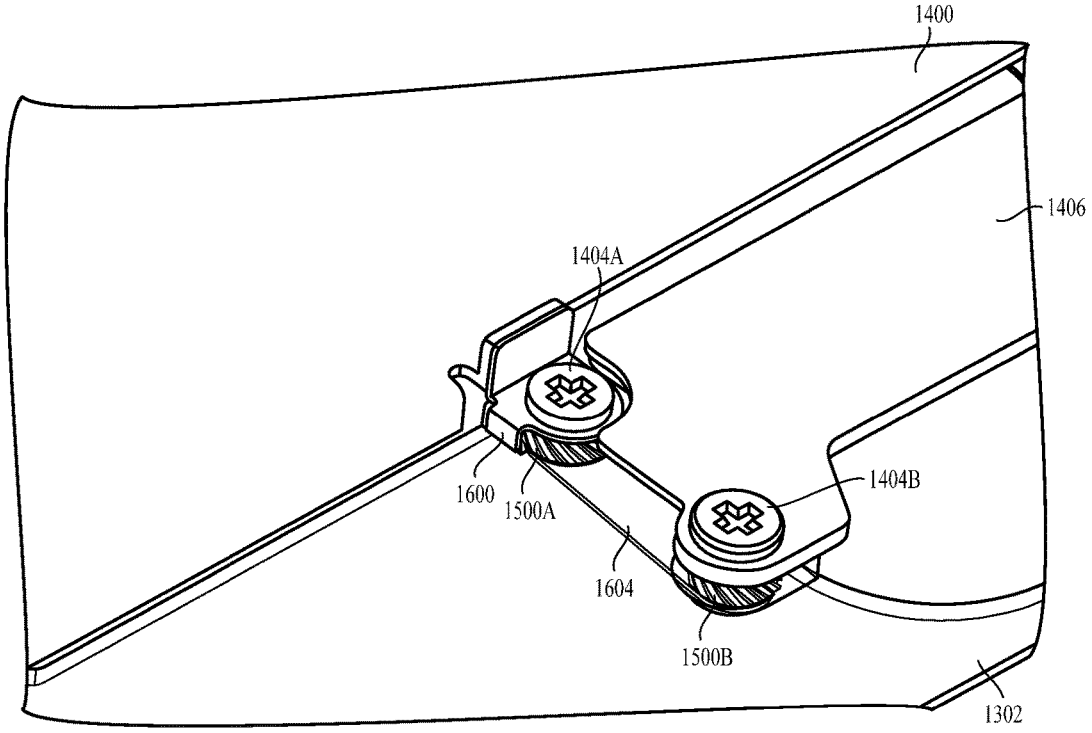

FIGS. 16 and 17 show a second embodiment of a tactile switch bracket connected to a grounded support plate. A conductive extension 1600 is connected to the grounded support plate 1400. Any suitable technique can be used to attach the conductive extension 1600 to the grounded support plate 1400. For example, the extension 1600 can be welded to the grounded support plate 1400 or attached using a conductive adhesive.

The extension 1600 extends out from the grounded support plate 1400 toward the tactile switch bracket 1406. The extension 1600 has an opening (not shown) at one end of the extension 1600 that is configured to receive the first fastener 1404A. The tactile switch bracket 1406 includes an opening (not shown) to receive the first fastener 1404B. The second fasteners 1500A, 1500B are attached to, or disposed in a conductive tie bar 1604 that is positioned between the input surface 1302 and the tactile switch bracket 1406. The conductive tie bar 1604 can be embedded in an electrically insulating plastic coating, such as in an overmolded plastic. The embedded tie bar 1604 may be attached to, or buried within, the input surface 1302.

When the first and second fasteners 1404A, 1500A and 1404B, 1500B are secured to each other, the tactile switch bracket 1406 is secured below the conductive tie bar 1604 and between the first and second fasteners 1404B, 1500B. The grounded support plate 1400 provides a grounding connection to the tactile switch bracket 1406 through the extension 1602, the first and second fasteners 1404A, 1500A, the conductive tie bar 1604, and the first and second fasteners 1404B, 1500B. Thus, a grounding connector includes the extension 1600, the first and second fasteners 1404A, 1500A, the conductive tie bar 1604, and the first and second fasteners 1404B, 1500B. The grounding connector can be assembled and disassembled without damage because the first fasteners 1404A, 1404B can be easily removed from the second fasteners 1500A, 1500B.

In addition to the foregoing, various other embodiments may employ different structures for grounding a tactile switch to a plate (support or otherwise) or housing. For example, a conductive jumper may be used; the jumper may be made of any suitable material, such as a sheet metal mesh, stainless steel mesh, or other metal mesh. Further, the conductive jumper may be fully or partly pliable in order to stretch during assembly. In some embodiments, the jumper may be connected to the support plate or an extension thereof by one or more fasteners, which may be removable. Alternately, the jumper may take the form of a flex circuit, coaxial connector, or the like and may be welded, crimped, soldered, or otherwise directly attached to one or both of the bracket and grounding element (e.g., plate or housing), instead of connected by a fastener.

As another example, a leaf spring may electrically connect and ground the switch to a plate or housing instead of a jumper. The leaf spring may also form such a connection while retaining some freedom of movement. Accordingly, the leaf spring could maintain the grounding connection while the switch bracket and plate shift or move with respect to one another, for example due to age or as a result of an impact. The leaf spring may be located either below the switch bracket or above it. In the latter example, the leaf spring may be positioned between the switch and the input surface. In yet other embodiments, a pogo spring may be used in lieu of a leaf spring.

During installation, the leaf spring may be held away from the grounded support plate by a shim. Upon installation, the shim may be removed to allow the region to be biased against the grounded support plate. The leaf spring itself is self-captured so it is protected from damage during installation.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. A tactile switch structure, comprising:

a switch operative to generate an electrical input;

a stiffener mechanically connected to the switch;

a first flexible circuit attached to a first surface of the stiffener;

a component chamber formed in the stiffener, wherein a portion of the first flexible circuit is exposed in the component chamber; and a grounding structure attached to the exposed portion of the first flexible circuit and electrically connecting the stiffener to the first flexible circuit.

2. The tactile switch structure of claim 1, wherein:

the grounding structure comprises a conductive post that is attached to the first flexible circuit with solder;

the solder fills at least a portion of the component chamber; and the solder contacts the conductive post and stiffener edges in the component chamber.

3. The tactile switch structure of claim 1, wherein:

the grounding structure comprises a conductive post attached to the first flexible circuit by a higher temperature solder; and a lower temperature solder at least partially fills the component chamber and contacts both the conductive post and stiffener edges in the component chamber.

4. The tactile switch structure of claim 3, wherein the stiffener edges in the component chamber are chamfered.

5. The tactile switch structure of claim 1, wherein the stiffener is attached to a trim at least partially adjacent the tactile switch structure, such that the stiffener is electrically connected to the trim.

6. The tactile switch structure of claim 5, further comprising a second flexible circuit attached to a second surface of the stiffener.

7. The tactile switch structure of claim 6, wherein the grounding structure comprises a wire bond having a first end attached to the second flexible circuit and a second end attached to the first flexible circuit.

8. The tactile switch structure of claim 7, wherein the wire bond is encapsulated with a nonconductive material.

9. A grounding structure for an input, comprising:

a flexible connector having a first and second surface, the first surface attached to a trim that is adjacent a switch associated with the grounding structure; and a stiffener attached to the second surface of the flexible connector;

and a grounding element attached to the second surface of the flexible connector and to the stiffner, wherein the grounding element comprises a conductive connector selected from the group consisting of a conductive post, a wire bond, and a wire crush rib; wherein a grounding connection is formed between the trim and the stiffener through the flexible connector.

10. The grounding structure of claim 9, wherein:

the stiffener is positioned under the second surface of the flexible connector; and the grounding connection is formed between the trim and the stiffener through the flexible connector and the grounding element.

11. An electronic device that includes a tactile switch assembly, comprising:

a tactile switch bracket associated with the tactile switch assembly;

a grounded component adjacent the tactile switch bracket; and a grounding connector attached to the grounded component and to the tactile switch bracket to provide a grounding connection to the tactile switch bracket;

a conductive tie bar adjacent a top surface of the tactile switch bracket, a first fastener positioned at a first end of the conductive tie bar, and a second fastener positioned at a second end of the conductive tie bar, wherein the first and second fasteners are positioned between the conductive tie bar and the tactile switch bracket.

12. The electronic device of claim 11, further comprising a frame positioned above the tactile switch bracket, wherein a first fastener is positioned on or within a surface of the frame that is opposite the tactile switch bracket.

13. The electronic device of claim 11, wherein:

the grounded component includes an extension extending toward the tactile switch bracket; and the tactile switch bracket includes a first opening that is configured to receive a first fastener.

14. The electronic device of claim 13, further comprising:

the second fastener configured to secure to the first fastener; and a conductive jumper adjacent a top surface of the tactile switch bracket and having a first end that is attached to the extension and a second end having a second opening configured to receive the first fastener, wherein the grounding connector comprising the extension, the conductive jumper, and the first fastener when the first and second fasteners are secured together.

15. The electronic device of claim 14, wherein the conductive jumper comprises a metal mesh.

16. The electronic device of claim 14, wherein the conductive jumper comprises a flexible circuit.

17. The electronic device of claim 11, wherein the grounding connector comprises a spring that is attached to the tactile switch bracket and contacts the grounded component.

* * * * *